United States Patent [19]

Yamauchi et al.

[11] Patent Number: 4,723,590

[45] Date of Patent: Feb. 9, 1988

[54] CONTINUOUS CASTING APPARATUS OF TWIN-DRUM TYPE

[75] Inventors: Takashi Yamauchi, Kudamatsu; Tadashi Nishino; Tomoaki Kimura, both of Hitachi; Tatsushi Aizawa, deceased late of Ibaraki-Ken, by Hisako Aizawa, legal representative, all of Japan

[73] Assignees: Hitachi, Ltd.; Nisshin Steel Co., Ltd., both of Tokyo, Japan

[21] Appl. No.: 893,173.

[22] Filed: Aug. 5, 1986

[30] Foreign Application Priority Data

Aug. 5, 1985 [JP] Japan ..... 60-171084

[51] Int. Cl.[4] ..... B22D 11/06

[52] U.S. Cl. ..... 164/428; 164/480

[58] Field of Search ..... 164/428, 480

[56] References Cited

FOREIGN PATENT DOCUMENTS

| | | | |
|---|---|---|---|
| 0127319 | 12/1984 | European Pat. Off. . | |
| 55-77962 | 6/1980 | Japan | 164/428 |
| 57-9565 | 1/1982 | Japan | 164/428 |
| 57-9566 | 1/1982 | Japan | 164/428 |
| 57-94456 | 6/1982 | Japan | 164/480 |
| 60-130450 | 7/1985 | Japan | 164/428 |

OTHER PUBLICATIONS

Abstract of Japanese Patent Publication 58-187244, Published Nov. 1, 1983.

Abstract of Japanese Patent Publication 58-218358, Published Dec. 19, 1983.

Abstract of Japanese Patent Publication 59-118249, Published Jul. 7, 1984.

Abstract of Japanese Patent Publication 60-21161, Published Feb. 2, 1985.

Abstract of Japanese Patent Publication 60-33859, Published Feb. 21, 1985.

*Primary Examiner*—Gene P. Crosby

*Assistant Examiner*—J. Reed Batten, Jr.

*Attorney, Agent, or Firm*—Fay, Sharpe, Beall, Fagan, Minnich & McKee

[57] ABSTRACT

A twin-roll type continuous casting apparatus comprises a pair of rotatable drums and a pair of side dams disposed on both axial ends of the drums so that a pool of molten steel is defined by the drums and the side dams. As the drums are rotated in counter directions, the molten steel is cooled so that the molten steel is partially solidified to form solidification shells which are then pressure-bonded to each other as they pass through the narrowest gap defined between the drums, so that a steel sheet is formed by continuous casting. The side dam is composed of a side refractory part which functions to maintain the pool of molten steel and a metallic member which supports the side refractory part and which serves as a cooling plate for cooling the steel. The side refractory part is projected inwardly of the pool from the metallic member and arranged so that the lower end thereof is positioned in the vicinity of a point where the pressure-bonding of the solidification shells is commenced, the point being located above the narrowest gap defined between the drums.

15 Claims, 11 Drawing Figures

CONTINUOUS CASTING APPARATUS OF TWIN-DRUM TYPE

BACKGROUND OF THE INVENTION

The present invention relates to a continuous casting apparatus of twin-drum type in which a molten steel is held in a pool defined by a pair of rolls or drums and a pair of side dams, the drums being rotatable in counter directions so that the molten steel is continuously extracted downward through the nip between the two drums, whereby a thin steel sheet is formed continuously.

Japanese Patent Laid Open No. 187244/1983 disclosed an example of the twin-drum type continuous casting apparatus having two drums which cooperate in defining therebetween a pool of molten steel. The molten steel in the pool is partially solidified to form solidification shells contacting these drums. As the drums rotate in counter directions so as to pinch and pull the molten steel downward, these solidification shells are pressure-bonded to each other when they pass through a gap between the two drums, whereby a steel sheet is formed continuously.

Referring to FIGS. 1 and 2, during the continuous casting of sheet 5 of thickness t with this casting apparatus, the solidification takes place earlier in the edge regions of the sheet than in the center of the same. In addition, when the semi-solidified steel passes through the smallest gap 4 between the drums 1, 1', at which gap 4 the pressure-bonding is finished, the solidification shells 3, 3' are pressed to each other to produce reactional pressure P, which acts to urge both drums away from each other as indicated by arrows in FIG. 1. At the same time, a pressure P3 is produced also in the lateral direction in the pressure-bonded portion of gap 4, i.e., in the breadthwise direction of the sheet, as illustrated in FIG. 2. This lateral pressure P3 acts to urge both side dams 2, 2' away from each other at portions of these dams confronting the pressure-bonded portion of gap 4 between the two drums. This lateral pressure becomes greater as the solidification proceeds, as explained in the above-mentioned Japanese Patent Laid-Open No. 187244/1983.

Generally, the molten steel temperature for casting steel sheet is as high as 1550° C. or so. The side dams 2, 2', therefore, are made of refractory bricks so that they may withstand this high temperature.

On the other hand, the lateral pressure P3 generated in the pressure-bonded portion between the drums which pressure-bonds the solidification shells is as high as about 200 kg/cm$^2$, because the solidification shells, which have been cooled down to 1350° to 1400° C., exhibit a deformation resistance which is substantially the same as that of hot steel.

Unfortunately, the side dams 2, 2' made of refractory bricks exhibit an extremely low strength at high temperature, and the dams are rapidly worn down due to abrasion by the pressure P3 shown in FIG. 2 as the thin sheet 5 is pulled downwardly. The wear of the side dams 2, 2' would be suppressed if the force by which the side dams are pressed is lowered. Such a reduced force, however, will allow the side dams 2, 2' to be displaced outwardly in the breadthwise direction of the sheet to thereby cause a side gap between the side dams 2, 2' and corresponding axial ends of the drums 1, 1' which gaps cause the molten steel to escape therethrough resulting in the formation of cast burr in the cast product, thus making it difficult to put the twin-drum type continuous casting apparatus into practical use.

In order to obviate this problem, the aforementioned Japanese Patent Laid-Open No. 187244/1983 proposes to use a material having a small heat conductivity in the portions of the drums corresponding to the breadthwise ends of the sheet. According to this proposal, the thickness of the solidification shell is small in the regions contacting the portions of the drums of the smaller heat conductivity so that the pressure caused when pressure-bonding is effected becomes smaller in such regions than in the breadthwise central portion, thus contributing to prolongation of the service life of the refractory side dams.

From a practical point of view, however, it is not preferred to construct the drum from two different kinks of materials having different physical properties, because such a drum is complicated construction and because a gap is apt to occur in a boundary between two kinds of materials into which gap molten steel is apt to leak to thereby make the casting impossible.

In most cases, the side dams are intended to be forced onto the axial end surfaces of the drums so as to form the pool of the molten steel, as explained in Japanese Patent Laid-Open No. 218358/1983. Such side dams are made from a refractory material, whereas the drums are made of a metal having a superior cooling property. Therefore, the side dams made of refractory material exhibit a higher temperature than the drums, so that the side dams are fragile and worn down rapdily.

Generally, when the casting speed is 30 m/min, the refractory material constituting the side dams is worn down in quite a short time, say about 1 minute. In consequence, a clearance is formed between each end of the drums and the opposing side dam. Thus, the apparatus cannot be used satisfactorily for the purpose of continuous casting for a long sheet.

On the other hand, Japanese Patent Laid-Open No. 38640/1983 discloses a twin-belt type continuous casting apparatus which employs stationary side plates each of which is constituted by a tapered refractory portion projected into the molten steel and a quenching metallic portion arranged in conformity with the breadth of the sheet, and a thickness adjusting roll which is intended for supporting both the solidified shells and the static pressure of the molten steel. Since this roll is not intended for the rolling (or pressure-bonding), no lateral spreading is caused by the rolling, so that the value of projection of the refractory material may be as small as several millimeters which correspond to the amount which may be lost by melting or exfoliation. It is also considered that the quenching metal plate can function satisfactorily if it is disposed in the vicinity of the thickness adjusting roll or downstream therefrom.

Unlike the twin-belt type apparatus, the twin-drum type continuous casting apparatus for directly casting a thin sheet of several millimeters essentially requires the rolling or pressure-bonding of a material immediately after the formation of the solidification shells, in order to obtain high quality of the cast product not only in the surface regions but also in the core portion of the product. It is, therefore, necessary to find a suitable construction and arrangement of the side dams. In other words, a suitable mechanism is essentially required for preventing the clearance from being caused between each of axial ends of the drums and each of opposing side dams, while allowing the cast material to be spread in the breadthwise direction.

Japanese Patent Laid-Open No. 21524/1974 discloses a twin-roll type casting apparatus in which the speed of the rolls is increased when the breadthwise spreading of the cast material during pressure-bonding of the solidification shells has increased a predetermined amount. On the other hand, Japanese Patent Laid-Open No. 21525/1984 discloses an apparatus in which side dams are moved upward in accordance with the amount of lateral spreading of the material during pressure-bonding of the solidification shells. In these known apparatus, however, the side dams which cooperate with the rolls or drums in defining the pool for the molten steel are made solely of a refractory material, and are inevitably damaged or worn as the material is largely spread laterally as a result of pressure-bonding of the solidification shells, which is necessary for attaining a high quality in the core part of the cast sheet. Thus, the requirement for the protection of the side dams and the requirement for the high quality of the core portion of the cast steel are incompatible with each other.

SUMMARY OF THE INVENTION

Accordingly, an object of the invention is to provide a twin-drum type continuous casting apparatus which is improved in such a way as to permit the breadthwise spreading of the material during the pressure-bonding of the solificiation shells effected between two drums, so as to ensure a high quality of the core part of the cast sheet, while ensuring tight seal between the drums and the side dams so as to prevent any leakage of the molten steel.

To this end, according to the invention, there is provided a twin-roll type continuous casting apparatus comprising: a pair of rotatable drums and a pair of side dams disposed on both axial ends of the drums so that a pool of molten steel is defined by both the drums and the side dams, the drums being rotated in counter directions so that the molten steel is partially solidified to form solidification shells which are then pressure-bonded to each other as they pass through the smallest or narrowest gap defined between the drums, thus forming a continuously cast steel sheet, characterized in that the side dam is composed of a side refractory part which functions to maintain the pool of molten steel and a metal member which supports the side refractory part, the side refractory part being projected inwardly of the pool from the metal member and arranged so that the lower end of the refractory part is positioned in the vicinity of a point where the pressure-bonding of the solidification shells is commenced, the point being located above the narrowest gap defined between the drums.

The above and other objects, features and advantages of the invention will become clear from the following description of the preferred embodiments when the same is read in conjunction with the accompanying drawings.

DESCRIPTION OF THE PREFERRED EMBODIMENTS

Figure 1:
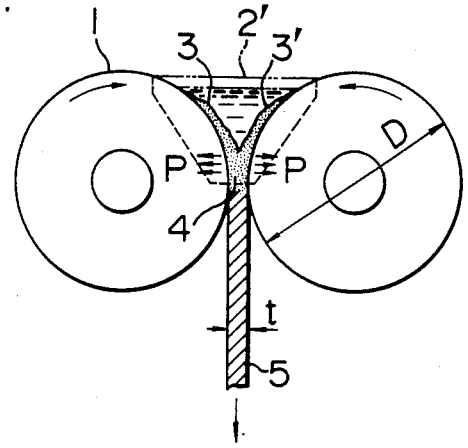
FIG. 1 PRIOR ART
FIG. 1 is a schematic illustration of a twin-drum type continuous casting apparatus, showing a pair of drums and solidification shells of a molten steel.
Figure 2:
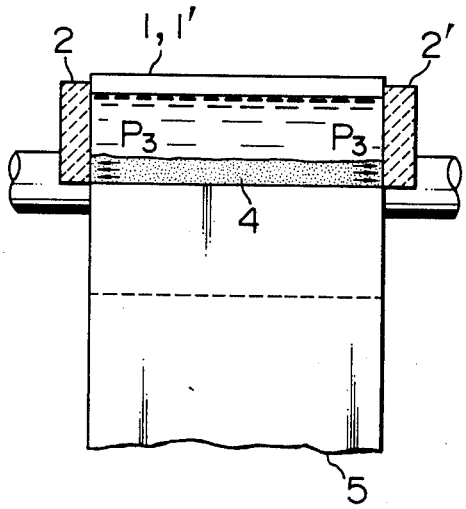
FIG. 2 PRIOR ART
FIG. 2 is a sectional view of the apparatus shown in FIG. 1 taken along a vertical plane which is parallel to the axes of the drums.
Figure 3:
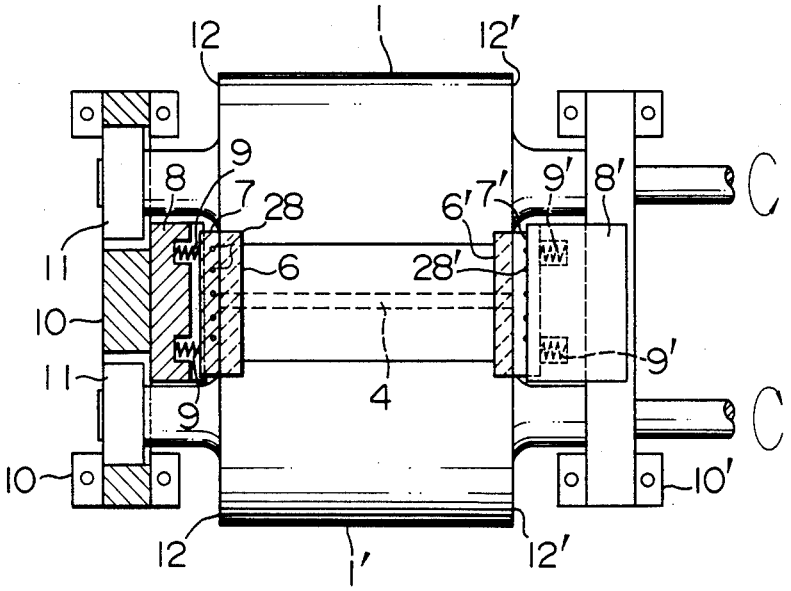
FIG. 3 is a partly-sectioned top plan view of a twin-drum type continuous casting apparatus embodying the present invention.

A first embodiment of the twin-drum type continuous casting apparatus will be explained hereinunder with reference to FIGS. 3, 4 and 5. The apparatus has side dams which are constituted by refractory side parts 6, 6' and cooling metal plates 7, 7' which support the side refractory parts 6, 6'. The side refractory parts 6, 6' are arranged to project from the axial end surfaces 12, 12' of a pair of drums 1, 1' by a value m into the space which forms a pool of the molten steel as will be explained later. Each of the side refractory parts 6, 6' has an arcuate configuration of a radius R of the drum, so as to extend along the periphery of the drums thereby preventing a clearance being caused between itself and the drums, thus avoiding leakage of the molten steel. The side refractory parts 6, 6' are integrally secured to respective metallic cooling plates 7, 7'. The cooling plates 7, 7' are provided with cooling fluid passages 28, 28' formed therein, so as to be cooled by the fluid flowing along these passages.

Figure 4:
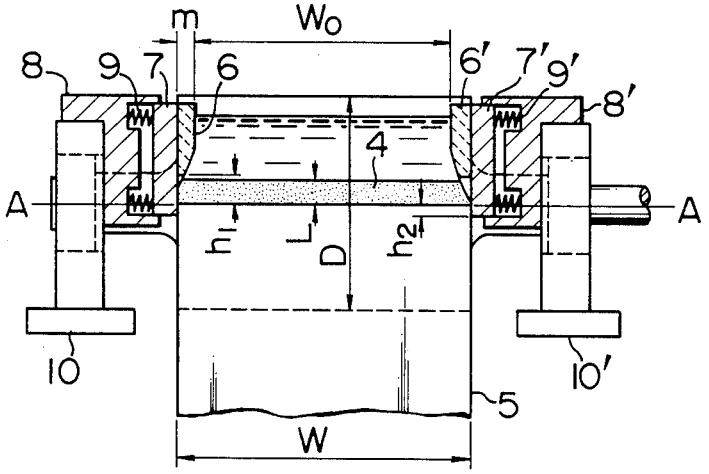
FIG. 4 is a sectional view of the apparatus shown in FIG. 3, taken along a vertical plane parallel to the axes of the drums.
Figure 5:
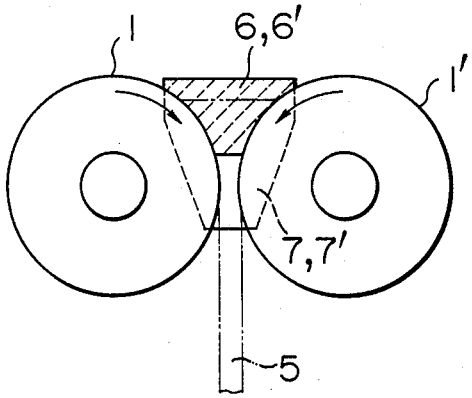
FIG. 5 is an end view of the continuous casting apparatus shown in FIG. 3.

From FIG. 4, it will be seen that the pool of the molten steel has an opening breadth $W_0$ which is smaller by the value of 2·m than the breadth W of the sheet to be obtained, into which pool is charged the molten steel. When the sheet breadth W is 1000 mm, the projection value m is preferably 5 to 30 mm and, hence, the opening breadth $W_0$ is 990 to 940 mm.

The side refractory parts 6, 6' are intended for stably holding the molten steel in the pool. As will be seen from FIG. 4, the side refractory parts 6, 6' are so arranged that their lower ends are positioned at a level which is higher by the amount of $h_1$ than the line A—A which passes the narrowest portion defined between two drums. It will be understood that the side refractory parts 6, 6' are not loaded by the lateral spreading of the steel material during pressure-bonding of the solidification shells, provided that the above-mentioned height $h_1$ is determined to be greater than the length L of a pressure-bonded portion defined between the point where the pressure-bonding of the solidification shells is commenced and the point where the gap defined between the two drums is minimized. On the other hand, the cooling plates 7, 7' are held in pressure contact with the solidification shells 3, 3' of the pressure-bonded portion 4, and are resiliently held in contact with the axial end surfaces 12, 12' of the drums by means of springs 9, 9' so as to prevent formation of casting burr even in case of a leakage of the molten steel. Thus, the cooling plates 7, 7' have such a configuration as to be maintained in close contact with the end surfaces of the drums 1, 1'. The springs 9, 9' as the resilient pressing means have to be adjusted such as to avoid any excessive loading of the cooling plates 7, 7' even when the drums have been thermally expanded during the casting. Needless to say, the resilient pressing means may be constituted by any suitable means other than the springs, such as a fluid-pressure type pressing means or cushioning members. The springs 9, 9' are backed up by back plates 8, 8', which in turn are secured to housings 10, 10' carrying drum bearing boxes 11 of the apparatus.

The vertical length of the metallic cooling plates 7, 7' are selected in such a manner that the cooling plates 7, 7' effectively fit on the end surfaces 12, 12' of the drums even at the beginning of the casting in which the level of the molten steel is still low. Moreover, in order to bear any leaked molten steel and to quickly solidify the same by cooling even in the steady operating condition shown in FIG. 4, it is preferred that the cooling plates 7, 7' extend downwardly to a level $h_2$ which is below the line A—A passing through the miminum gap portion defined between the two drums of diameter D. The level or height $h_2$ is variable between 0 and 100 mm.

Preferably, the side refractory parts 6, 6' are disposed not to confront the pressure-bonded portion of gap 4 in which the solidification shells are pressure-bonded by both drums. However, since the lateral or breadthwise spreading of the steel material during the pressure-bonding of the solidification shells proceeds only gradually, the effect of the invention is not impaired even when the side refractory parts confront the pressure-bonded portion of gap 4, provided that the lower end portions of the side refractory parts 6, 6' are tapered by an amount large enough to accommodate the lateral or breadthwise spreading of the material. This, however, is not allowed when the sheet to be cast has an extremely small thickness of 2 to 3 mm because in such case the side refractory parts 6, 6' also are thin and fragile.

Thus, a practical arrangement is obtained by selecting the distance $h_1$ defined between the line A—A passing the narrowest point of the gap 4 and the lower ends of the side refractory parts 6, 6' to be not less than the distance L defined between the point at which the pressure-bonding of the solidification shells is commenced and the point at which the gap of the drums is minimized, while disposing the metallic cooling plates 7, 7' having the internal cooling fluid passages 28 and supporting the side refractory parts 6, 6' at a position retracted outwardly from the breadthwise ends of the sheet, in such a manner that the cooling plates 7, 7' are held in contact with the end surfaces of both drums 1, 1'.

An explanation will be given hereinunder as to the positional relationship between the lower ends of the side refractory parts 6, 6' and the rolling-commencing point at which the pressure-bonding of the solidification shell is commenced.

Figure 7:
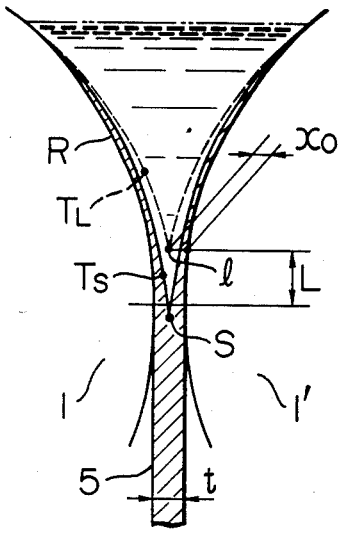
FIG. 7 is an enlarged view of the narrowest gap defined between two drums in the continuous casting apparatus of the invention as viewed in the direction of axes of the drums, illustrating the state of pressure-bonding of solidification shells.

Referring to FIG. 7, from the view point of the effect of pressure-bonding, the arrangement is preferably such that the pressure bonding of the solidification shell is conducted at a region between the point of "l" where the liquidus $T_L$ defining the liquid phase of the molten steel merge in each other and the point "S" at which the solidus $T_S$ defining the solidification shells merge in each other as the drums rotate.

If the point "S" is located above the narrowest gap point defined between two drums, the drums are required to roll an already solidified sheet, which in turn requires an extremely large pressing force, resulting in an increase in the size of the apparatus as a whole.

Conversely, when both the points "l" and "S" are below the narrowest gap point, there is a risk of squeezing out of the molten steel or a bulging of the cast sheet due to static pressure of the molten steel sandwiched between the solification shells, with a result that the continuous casting is impeded seriously.

In the illustrated embodiment, there is effected the pressure-bonding of semi-solidified portions defined between the lines $T_L$ and $T_S$, so that the drums encounter an extremely small deformation resistance of 1 to 2 kg/mm$^2$ or less, thus enabling the drum screw-down device and the driving device to have reduced sizes. A reduced rolling force in turn minimizes the tendency of degradation in the shape or profile of the cast thin sheet which may otherwise be caused by application of a large rolling force. In general, when an extremely large rolling force is applied to the solidification shells they have non-uniform thickness distribution along the breadth, particularly large thickness portions at breadthwise ends, which are apt to be rolled heavier than other portions so as to cause a spreading of the material in the longitudinal direction of the sheet, resulting in a deterioration of the shape or profile of the sheet as the product. According to the invention, however, this problem is overcome because the rolling force is small enough to avoid such drawback. Namely, the undesirable waving which is experienced when a material having large thickness is rolled by a large rolling force is effectively avoided in the present invention, because of the reduced rolling force.

The pressure-bonding of the unsolidified portion of the material causes lateral or breadthwise spreading of the material, so that the refractory side dams would be worn down quickly if they are positioned in the area where the unsolidified steel is pressed, as explained already. According to the invention, therefore, the side dams are arranged such that their lower ends are positioned above the level of point "1" at which the pressure-bonding is commenced. The optimum value of the level L of this point "1" above line A—A, FIG. 7 and FIG. 4, is given by the following formula where R is the radius of the cooling drum, X is the distance of "1" from the drum and t is the sheet thickness:

$$L \approx \sqrt{R(2x_0 - t)} \approx 2\sim4\sqrt{R}$$

Figure 10:
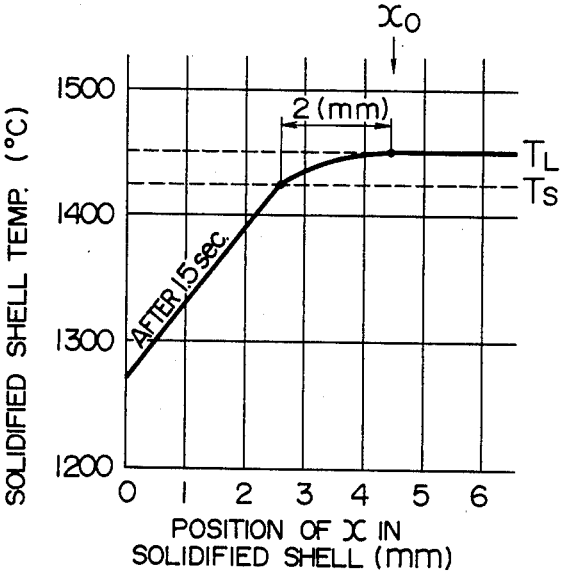
FIG. 10 is diagram showing the temperatures exhibited by different portions of the solidification shell.

FIG. 10 shows the temperature of the solidification shells vs. distance from a cooling drum after 1.5 seconds of cooling as observed when the molten steel material is AISI 304 stainless steel. It is assumed that, in order to obtain a sheet having a thickness (t) of 5 mm with drums having radii R of 400 mm, the solidification shells are pressure-bonded together at a moment 1.5 second after the commencement of cooling. In such a case, since the value $x_0$ is 4.5 mm as seen from FIG. 10, the level L is calculated as follows:

$$L \approx \sqrt{400 \times (2 \times 4.5 - 5)} = 40 \text{ mm}$$

Thus, the position $h_1$ (FIG. 4) of the lower ends of the side dams is given by $h_1 = 40 + \alpha = 50$ to 60 mm, where $\alpha$ is the desired spacing of the refractory material above point "1". In this case, the level L is roughly approximated by $2 \cdot \sqrt{R}$ to $4 \cdot \sqrt{R}$.

An explanation will be given hereinunder as to the amount of projection of the side refractory parts 6, 6' of the side dams into the molten steel, the projection being provided to accommodate the breadthwise spreading of the material during the pressure-bonding of the solidification shells.

Figure 8:
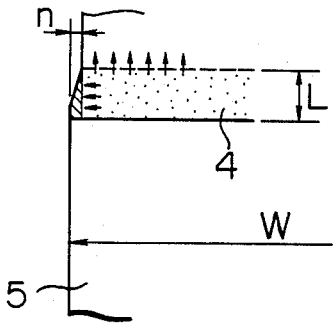
FIG. 8 is an illustration of the state of lateral or breadthwise spreading of the cast material during the pressure-bonding of the solidification shells.
Figure 9:
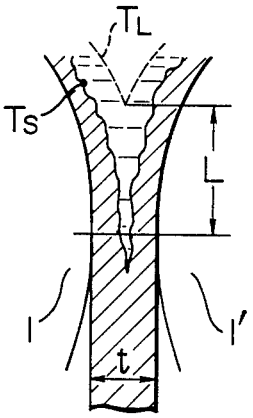
FIG. 9 is an enlarged view of the pressure-bonded shell portion.

As shown in FIG. 8, the semi-solidified shells are spread both upward and laterally outward, by the application of the pressure-bonding force. The amount of spreading in each direction depends on the flow resistance at the solidification interface $T_S$. Actually, however, the solidification interface is undulated slightly as shown in FIG. 9, and fluctuates depending on various factors such as a cooling condition, a kind of material and so forth. When the pressure-bonding is conducted under such conditions, the material in the central part is moved in the upward direction in which it encounters a smaller flow resistance, while the breadthwise end portions are displaced laterally outwardly. Thus, the amount n of laterally outward spreading of the material on each side of the sheet mainly affects the thickness t of the product but is not scarecely affected by the breadth of the sheet. This fact has been confirmed through experiments, and the amount n generally ranges between $0.2 \cdot t$ and $0.5 \cdot t$.

Thus, when the thickness t is 5 mm for example, the amount n of lateral spreading is about 1 to 2 mm. According to the invention, each of the side refractory parts 6, 6' is projected by the amount m which is somewhat greater than the amount n of lateral spreading of the material. Thus, in the continuous casting of a sheet having a thickness in a range between 3 and 3 mm, a high quality of the product is usually obtained when the projection amount m is substantially the same as the sheet thickness.

Thus, in the described embodiment of the invention, the side refractory parts are projected inwardly from the plane of the end surfaces of the drums and are arranged to closely fit on the outer peripheral surfaces of the drums without leaving substantial gap therebetween, so as to delay the commencement of solidification of the breadthwise ends of the sheet, while preventing the forcing out of the material at the breadthwise ends of the sheet. Thus, no refractory member is disposed in the region where the solidification shells are pressure-bonded. Instead, cooling plates are disposed in the region where the shells are pressure-bonded, in such a manner that the cooling plates are positioned laterally outside of the side refractory parts and held in contact with the axial end surfaces of the drums. In other words, each side dam has a stepped portion in a breadth direction so that the commencement of cooling is delayed thereby preventing generation of lateral or breadthwise spreading force $P_3$.

The portions of the side dams contacting the axial end surfaces of the drums are constituted not by the refractory material but the cooling plates of a metallic material which exhibits a higher resistance to abrasion, and the refractory parts of the side dams are supported by the metallic cooling plates.

The cooling plates may be made of a bearing alloy such as bronze, aluminum bronze and the like, and the sliding surfaces thereon may be supplied with a lubricating oil so as to minimize the abrasion of both the drums and the cooling plates.

It will be seen that the pool of molten steel is maintained by the refractory parts which fit in the space between the drums without substantial clearance and the refractory parts are held by the metallic cooling plates which are held in sliding and sealing contact with the axial end surfaces of the drums.

In addition, the lower ends of the refractory parts of the side dams are positioned at the same level as or slightly above the level at which the solidification shells are pressure-bonded, while the metallic cooling plates supporting the refractory parts and intended for cooling the breadthwise ends of the sheet are slightly retracted laterally outward from the plane of the refractory parts.

Figure 6:
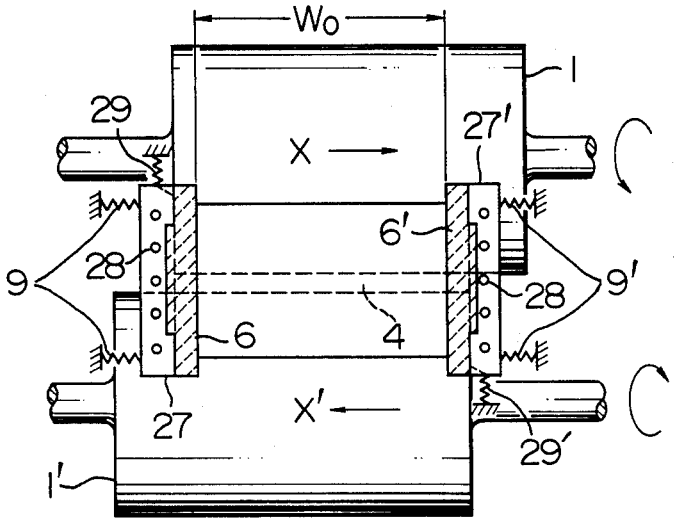
FIG. 6 is a schematic illustration of the construction of another embodiment of the twin-drum type continuous casting apparatus of the invention.
Figure 11:
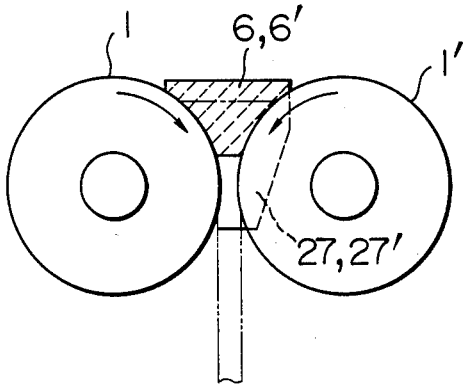
FIG. 11 is a side elevational view of the twin-drum type continuous casting apparatus shown in FIG. 6.

Another embodiment of the invention will be explained hereinunder with reference to FIGS. 6 and 11. In this embodiment of the twin-drum type continuous casting apparatus, the drums are movable in the axial direction in accordance with a change in the breadth of the sheet.

Since the major parts of this embodiment are the same as those of the first embodiment, the description will be mainly focused only on the points which distinguish this embodiment from the first embodiment.

In this embodiment, both drums 1, 1' are movable in the axial direction as indicated by arrows X and X' so as to vary the breadth $W_0$ of the casting region, thereby attaining the sheet breadth W coinciding with the desired casting breadth $W_0$. The axial movement of the drums is caused by a conventional mechanism which is omitted from the drawings. In this embodiment also, side refractory parts 6, 6' are fitted into the space between both drums 1, 1'. In addition, springs 29, 29' as pressiing means are provided besides the aforementioned springs 9, 9' so as to force each of the cooling plates 27, 27' against the peripheral surface of the drums 1, 1', respectively. The arrangement is such that each of the cooling plates 27, 27' has such a curved configuration as to fit the outer surface of the drum, and is forced by the spring 29 or 29' into contact with only one of the drums 1, 1'. It will be understood that the desired construction of the side dams and pressing springs enables the invention to be applied also to the continuous casting apparatus in which the drums are axially movable to vary the breadth of the sheet to be cast.

Thus, in the described embodiments of the invention, each side dam is composed of two different portions: namely, a portion for maintaining the pool of the molten steel and a portion facing the region where the solidification shells are pressure-bonded. The side refractory parts for maintaining the pool of the molten steel are projected inwardly of the breadthwise ends of the sheet to be formed by an amount corresponding to the lateral spreading of the material which will be caused by the pressure-bonding of the solidified shells, above a position where the pressure-bonding of the solidification shells is commenced, thereby to delay the start of solidification of the breadthwise ends of the semi-solidified steel material. On the other hand, the portion of each side dam confronting the region where the pressure-bonding is effected, i.e., the cooling plate of each side dam, is so positioned as to provide the desired sheet breadth after the pressure-bonding, by accommodating the possible lateral displacement of the material. Therefore, a breadthwise spreading force does not occur even when the steel material is spread laterally outwardly during the pressure-bonding of the solidification shells. It is thus possible to prevent any breakage or local wear of the side refractory parts. In addition, the leaking of the molten steel is avoided even in the beginning period of the continuous casting in which the steel material in the pressure-bonded portion between two drums is still in molten state, whereby the continuous casting is performed stably over the entire period.

As has been described, in the twin-drum type continuous casting apparatus of the invention, the lateral spreading of the steel material during the pressure-bonding of the solidification shells for ensuring the high quality of the core part of the cast product is allowed while ensuring the seal of the molten steel between the side dams and the end surfaces of the drums.

What is claimed is:

1. A twin-roll type continuous casting apparatus comprising: a pair of rotatable drums and a pair of side dams disposed on both axial ends of said drums so that a pool of molten steel is defined by said drums and said side dams, said drums being adapted to be rotated in counter directions and to cool the molten steel in the pool to thereby provide solidified shells of the molten steel on the surfaces of the drums, said solidified shells being than pressure-bonded to each other as they pass through the narrowest gap defined between said drums to thereby form a continuous steel sheet, each of said dams being composed of a side refractory part which functions to maintain the pool of molten steel and a metallic member which supports said side refractory part, said side refractory part being projected inwardly of said pool from said metallic member, said side refractory part being arranged so that the lower end thereof is positioned in the vicinity of a point where the pressure-bonding of said solidification shells is commenced which point is located above the narrowest gap defined between said drums.

2. A twin-roll type continuous casting apparatus according to claim 1 wherein the distance between the level of the narrowest gap defined between said drums and the lower end of said side refractory part of end of said side dams ranges between $2\cdot\sqrt{R}$ and $4\cdot\sqrt{R}$ in which R is the value of the radius of said drums.

3. A twin-roll type continuous casting apparatus according to claim 1, wherein said each side dam comprises pressing means for forcing said metallic member into pressure-contact with the axial end surfaces of said drums.

4. A twin-roll type continuous casting apparatus according to claim 3, wherein said drums are movable in the axial direction thereof, and said side dams are arranged so that said metallic member is held in sliding contact with the barrel of at least one of said drums, said apparatus further comprising a second pressing means for forcing said metallic member of each of said side dams into pressure-contact with the barrel portions of said drums.

5. A twin-roll type continuous casting apparatus according to claim 3, wherein the distance between the level of the narrowest gap defined between said drums and the lower end of said side refractory part of each of said side dams ranges between $2\sqrt{R}$ and $4\sqrt{R}$ in which R is the value of the radius of said drums.

6. A twin-roll type continuous casting apparatus according to claim 1 wherein said drums are movable in the axial direction thereof, and said side dams are arranged so that said metallic member is held in sliding contact with the barrel of at least one of said drums, said apparatus further comprising a second pressing means for forcing said metallic member of each of said side dams into pressure-contact with the barrel portions of said drums.

7. A twin-roll type continuous casting apparatus according to claim 6, wherein the distance between the level of the narrowest gap defined between said drums and the lower end of said side refractory part of each of said side dams ranges between $2\sqrt{R}$ and $4\sqrt{R}$ in which R is the value of the radius of said drums.

8. A twin-roll type continuous casting apparatus according to claim 1, wherein said side refractory part of each side dam is projected by an amount in a range of 0.2 to 0.5 times of the value of the thickness of the sheet to be produced.

9. A twin-roll type continuous casting apparatus according to claim 8, wherein the distance between the level of the narrowest gap defined between said drums and the lower end of said side refractory part of each of said side dams ranges between $2\sqrt{R}$ and $4\sqrt{R}$ in which R is the value of the radius of said drums.

10. In a twin-roll type continuous casting apparatus having a pair of rotatably mounted drums and a pair of side dams disposed on both axial ends of the drums so that a pool of molten steel is defined by the drums and the dams, the drums being mounted for rotation in counter directions and to cool the molten steel in the pool to thereby provide solidified shells of the molten steel on the peripheral surfaces of the drums, the solidified shells being then pressure-bonded to each other as they pass between the narrowest gap defined between the drums to thereby form a continuous steel sheet, each of the side dams being composed of a side refractory part to maintain the pool of molten steel and a metallic member to support the refractory part and to axially sealingly engage the axial end surface of an adjacent drum, the improvement comprising:

the side refractory part of each of said side dams projecting inwardly toward the pool and from the metallic member to be spaced axially inward from the metallic member and the axial end surface of the adjacent drum that engages the metallic member;

said side dams defining therebetween the opening breadth of the pool of molten steel as measured in the axial direction and the breadth of the steel sheet between the narrowest gap defined between said drums, and said refractory part of each of said side dams being outwardly relieved from a point where the pressure bonding of the solidification shells is commenced to the narrowest gap defined between said drums so that the breadth of the steel sheet is substantially greater than the opening breadth of the pool of molten steel so that when said solidification shells are pressure-bonded to each other as they pass through the narrowest gap defined by said drums the solidified steel may expand axially without moving said metallic member of each of said side dams away from the axially sealing engagement with the axial end surface of an adjacent drum to thereby prevent leakage of the molten steel.

11. The twin roll type continuous casting apparatus according to claim 10, wherein said side refractory part of each of said side dams has a lowermost end in the vicinity of said point where the pressure bonding of the solidification shells is commenced, sealingly engaged and said metallic member is substantially coplanar with the axial end surface of the adjacent drum.

12. The twin roll type continuous casting apparatus according to claim 11, wherein said side refractory part of each of said side dams has a side surface for engaging the pool of molten steel that is substantially radially planar and a transition surface that slopes downwardly and outwardly from said radially planar surface to said lowermost end.

13. The twin roll type continuous casting apparatus according to claim 12, further comprising means for pressing said side dams axially inwardly; and means for cooling said side dams.

14. The twin roll type continuous casting apparatus of claim 13, wherein said drums at respective axial ends have coplanar axial end surfaces and said metallic member of each of said side dams has a sealing surface engaging and coplanar with said axial end surface of each adjacent ones of said drums; and said side refractory part of each of said side dams having opposite arcuate ends engaging and conforming to the peripheral surface of each adjacent ones of said drums.

15. The twin roll type continuous casting apparatus according to claim 13, wherein said drums are axially offset; means for axially relatively adjusting said drums to change the amount of offset; said side refractory part of each of said side dams having opposite arcuate end surfaces conforming to and engaging the adjacent peripheral surface of each adjacent one of said drums; said metallic member of each of said side dams having an arcuate surface conforming to and engaging the periphery of the other adjacent drum than the drum having its end surface axially sealingly engaging the other end of the refractory part; and means resiliently biasing said metallic member and side refractory part of each of said dams radially toward its engagement with the adjacent peripheral surface of the corresponding adjacent drum.

* * * * *